United States Patent [19]

Ermilov et al.

[11] Patent Number: 4,896,130

[45] Date of Patent: Jan. 23, 1990

[54] MAGNETIC SYSTEM

[76] Inventors: Igor V. Ermilov, ulitsa Sovetskaya, 31, kv. 24, Reutov, Moskovskaya oblast; Lev V. Kozlov, Marxistskaya ulitsa, 1, korpus 1, kv. 199, Moscow; Vladimir F. Martynov, ulitsa Volkovskaya, 5a, kv. 3, Ljubertsy, Moskovskaya oblast; Vladimir I. Perevodchikov, ulitsa Krzhizhanovskogo, 4, korpus 2, kv. 32; Evgeny I. Stepanenko, ulitsa Kutuzova, 9, kv. 33, both of Moscow, all of U.S.S.R.

[21] Appl. No.: 271,602

[22] Filed: Nov. 15, 1988

[30] Foreign Application Priority Data

Nov. 16, 1987 [SU] U.S.S.R. ..... 4328105

[51] Int. Cl.[4] ..... H01F 5/00

[52] U.S. Cl. ..... 335/300

[58] Field of Search ..... 335/299, 300; 336/55, 336/61

[56] References Cited

U.S. PATENT DOCUMENTS

| | | | |
|---|---|---|---|
| 3,056,071 | 9/1962 | Baker et al. | 335/300 |
| 3,295,082 | 12/1966 | Kustom et al. | 335/300 X |
| 3,501,727 | 3/1970 | Kafka | 335/300 |
| 4,593,261 | 6/1986 | Forster et al. | 335/300 |

*Primary Examiner*—George Harris

*Attorney, Agent, or Firm*—Lilling & Greenspan

[57] ABSTRACT

A magnetic system comprises a frame with at least one coil arranged coaxially thereon and providing for the setting-up of a magnetic field, and a cooling system. Wound in layers on a former of each coil are conducting and insulating tapes encompassed by a serving on an outer surface. Means for circulating coolant are disposed in close proximity to end surfaces of the coils, a gap being provided to allow flow of said coolant between the end surface of the coils and said means. The end surfaces of the coils are formed substantially by extremities of the conducting and insulating tapes.

22 Claims, 7 Drawing Sheets

MAGNETIC SYSTEM

BACKGROUND OF THE INVENTION

1. Field of the Invention

The present invention relates to electrical engineering and, in particular, to magnetic systems.

The invention may find applications in electronbeam magnetic tracking system of accelerators and plasma oscillators, as well as in various electrotechnical devices as reactors, transformer windings, field structures and toroidal magnetic systems of thermonuclear plants.

2. Description of the Prior Art

Two major problems are generally encountered in developing magnetic systems for establishment of strong magnetic fields, more specifically, stresses and heating of coils for setting up a magnetic field.

A widely known magnetic system (GB, B, 1,344,366) comprises coils providing for establishment of a magnetic field, conducting and insulating tapes being wound in layers on a former thereof, and a cooling system formed with channels disposed round the periphery of the coils. Coolant is passed through the channels. The efficiency of such a system is generally low for the cooling is effected through a layer of insulating tape.

Another commonly known magnetic system (GB, B, 1,172,026) comprises coils providing for the setting-up of a magnetic field, conducting and insulating tapes being wound on a former of said coils. Wrought in the conducting tape are channels through which coolant is passed after the conducting and insulating tapes are wound. The provision of channels in a coil decreases its mechanical strength since stresses are concentrated in such channels.

One more widely known magnetic system (cf. DE, C, 1,279,182) comprises a frame with at least one coil arranged coaxially thereon and providing for the setting-up of a magnetic field, and a cooling system. The magnetic system is contained within a casting filled with coolant. Wound in layers on a former of the coils are conducting and insulating tapes encompassed by a serving on an outer surface. Interposed between adjacent layers of the conducting and insulating tapes is a layer of heat-conducting foil, which is considerably raised above the end surface of the coil, edges of said layer being in contact with coolant. The aforementioned magnetic system has a small space factor for its coils are insufficiently filled with conductive material due to noticeable projection of the edges of said layer of heat-conducting coil. If the edges of said layer of heat-conducting foil insigificantly extend above the end surface of the coils, the number of turns of said layer of heat-conduction foil has to be increased, a limitation resulting in a smaller space factor in filling coils with conductive material and, consequently, in decreased induction of a magnetic field.

SUMMARY OF THE INVENTION

It is an object of the present invention to enhance effectiveness in cooling end surfaces of coils of a magnetic system.

Another object of the invention is to preclude electrochemical erosion of cooled surfaces of coils.

One more object of the invention is to increase a space factor in filling coils of a magnetic system with conductive material.

There is provided a magnetic system comprising a frame with at least one coil arranged coaxially thereon and providing for the setting-up a magnetic field, conducting and insulating tapes being wound in layers on a former of the coil and encompassed by a serving on an outer surface, and a cooling system, in which, according to the invention, means for circulating coolant are disposed in close proximity to end surfaces of the coils, a gap being provided between the end surface of each coil and said means, the end surfaces of the coils being formed substantially by extremities of the conducting and insulating tapes.

It is advantageous that, in order to decrease dimensions of the magnetic system, means for circulating coolant should represent cheeks made to suit the shape of the end surface of the coils and secured on ends of the formers and servings, the cheeks having two holes adapted to receive inlet and outlet pipes for the coolant, a radial partition being provided therebetween, the height of said partition being equal to the height of the gap between the end surface of each coil and the cheek.

To ensure a uniform height of the gap between the end surface of the coil and the cheek, said cheeks preferably comprise projections arranged round the inner and outer periphery thereof and secured, respectively, on ends of the formers and servings.

It is also advantageous that, in order to ensure a uniform height of the gap between the end surface of the coil and the cheek, spacers should be placed along the inner and outer periphery of the end surfaces of the coils so as to provide a desired gap between the end surface of each coil and the cheek.

To enhance effectiveness in cooling the coils and prevent electrochemical erosion of cooled surfaces of the coils providing for the setting-up of a magnetic field, the magnetic system forming the subject of the present invention advantageously comprises an additional casing made up of an external enclosure and an internal wall, flanges being secured on two ends thereof so that said casing forms in conjunction with the frame a hermetically sealed cavity filled with coolant and accommodating the coils, the means for circulating the coolant being made as disk partitions of a suitable insulating material, said partitions being secured round the inner and outer periphery, respectively, on the former of the coils and on the internal wall of the casing, while gap is provided between the frame and the inner surface of the coil formers to allow the flow of the coolant.

It is preferable that, to improve operational quality of the magnetic system, the coil formers should be interconnected by means of projections and slots made on respective ends of the interconnected coil formers and fitted in each other.

It is also preferable that, with a view to enhancing effectiveness in cooling the magnetic system, the disk partitions should have holes along the inner periphery, a gap being provided between the outer lateral surface of the coils and the internal wall of the casing to allow the flow of the coolant.

It is also advantageous that, in order to increase effectiveness in cooling the magnetic system, the disk partitions should have holes around the inner periphery and hermetically abut on the external enclosure of the casing around its outer periphery, the internal wall of the casing being tightly fitted to the outer lateral surface of the coils and having holes arranged on both sides symmetrically with the point of attachment of the disk partition therein.

It is further advantageous that, in order to increase effectiveness in cooling the magnetic system, the disk partitions should be made continuous, holes provided in the internal wall of the casing and the coil formers, said holes being arranged on both sides symmetrically with the point of attachment of the disk partition therein, the internal wall of the casing being tightly fitted to the outer lateral surface of the coils.

To make cooling of the magnetic system more effective, the disk partitions desirably have holes round the outer periphery and hermetically abut on the frame around its inner periphery, the internal wall of the casing being tightly fitted to the outer lateral surface of the coils, whereas the coil formers have holes disposed on both sides symmetrically with the point of attachment of the disk partitions therein.

To ensure uniform distribution of the coolant, the surface of each means for circulating said coolant is preferably fitted with at least two radially arranged insulating spacers whose height is equal to the height of the gap between the end surface of each coil and said means.

Transverse channels are desirably provided in the insulating spacers so that the coolant is distributed in an essentially uniform manner.

The provision in the magnetic system of means for circulating coolant, arranged in close proximity to end surfaces of coils providing for the setting-up of a magnetic field makes it possible to enhance effectiveness in cooling the coils, increase a space factor in filling windings of said coils with conducting material, obtain greater induction of a magnetic field in the proposed magnetic system, and preclude electrochemical erosion of cooled surfaces of the magnetic system.

BRIEF DESCRIPTION OF THE DRAWINGS

The invention will now be described further with reference to specific embodiments of the proposed magnetic system, taken in conjunction with the accompanying drawings, wherein.

DESCRIPTION OF THE PREFERRED EMBODIMENTS

Figure 1:
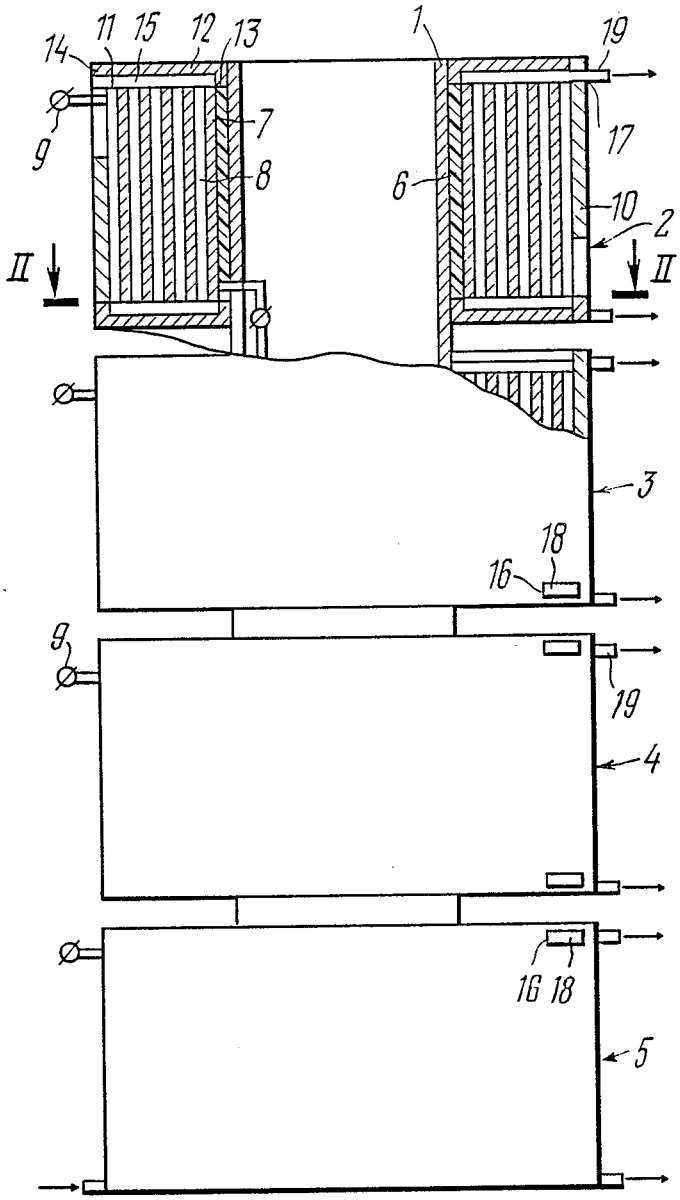
FIG. 1 is one embodiment of a magnetic system (partial longitudinal section, side view) according to the invention.

The magnetic system forming the subject of the present invention comprises a cylindrical frame 1 (FIG. 1) mounting coaxially arranged coils 2, 3, 4 and 5 used to set up a magnetic field. Each of the coils 2, 3, 4 and 5 comprises a former 6, conducting and insulating tapes 7 and 8 being wound in layers on said former and cemented with compound. Current leads 9 are soldered to ends of the conducting tape 7. The conducting and insulating tapes 7 and 8 are encompassed by a serving 10 on an outer surface. End surfaces 11 of the coils 2, 3, 4 and 5 are formed substantially by extremities of the conducting and insulating tapes 7 and 8, which is accomplished by working the end surfaces 11 of the coils 2, 3, 4 and 5, for example, by stripping insulation on the end surfaces 11 by the use of a lathe.

Figure 2:
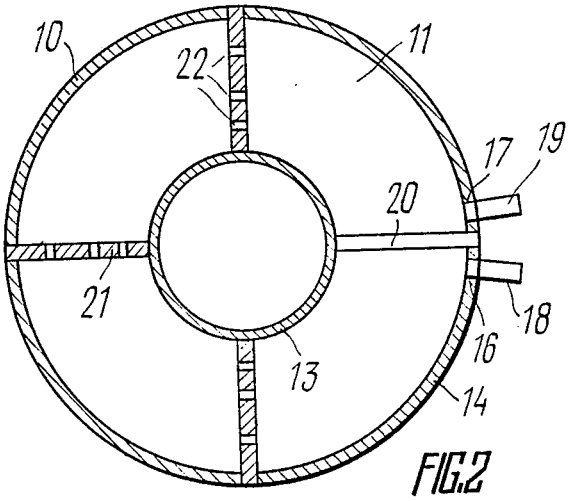
FIG. 2 is a cross-sectional view taken along line II—II according to the invention.

Means for circulating coolant are arranged in close proximity to the end surfaces 11 of each of the coils 2, 3, 4 and 5 providing for the setting-up of magnetic field. Said means for circulating coolant comprise cheeks 12 which suit the shape of the end surface 11 of the coils 2, 3, 4, and 5. Each of the cheeks 12 has projections 13 and 14 arranged round the inner and outer periphery and secured, respectively, on ends of the former 6 and the serving 10 of each coil 2, 3, 4 and 5. A gap 15 is provided between the end surface 11 of each of the coils 2, 3, 4, 5 and the cheek 12. Each cheek 12 has two holes 16, 17 (FIG. 2) in the projection 14 (FIG. 1).

Arranged in the holes 16, 17 are inlet and outlet pipes 18, 19 for the coolant of the cooling system. A partition 20 (FIG. 2) is radially disposed between the coolant inlet and outlet holes 16 and 17 of each cheek 12, the height of said partition being equal to the height of the gap 15 (FIG. 1).

Secured on the surface of each cheek 12 are three radially disposed insulating spacers 21 (FIG. 2) whose height is equal to the height of the gap 15 between the end surface 11 of the coils 2, 3, 4, 5 and the cheeks 12. Transverse channels 22 are provided in the insulating spacers 21.

In another embodiment of the magnetic system, the frame 1 (FIG. 3, 4) is a toroidal structure mounting coaxially arranged V-shaped coils 23 representing torus segments, each of which includes the former 6 with the conducting and insulating tapes 7, 6 wound thereon, and the serving 10. Arranged in close proximity to the end surfaces 11 of each coil 23 are the cheeks 12 secured on ends of the frame 6 and the serving 10 of each coil 23 with the help of spacers 24, 25 (FIG. 4) arranged round the inner and outer periphery of the end surfaces 11 of each coil 23. The gap 15 allowing flow of coolant is provided between the end surface 11 of each coil 23 and the cheek 12. Each cheek 12 has two holes 26 to let in and out the coolant. Pipes 27 and 28 of the cooling system are placed in each hole. Disposed radially between the pipes 27 and 28 of each cheek 12 is a partition 29 whose height is equal to the height of the gap 15 between the end surface 11 of the coil 23 and the cheek 12.

Figure 5:
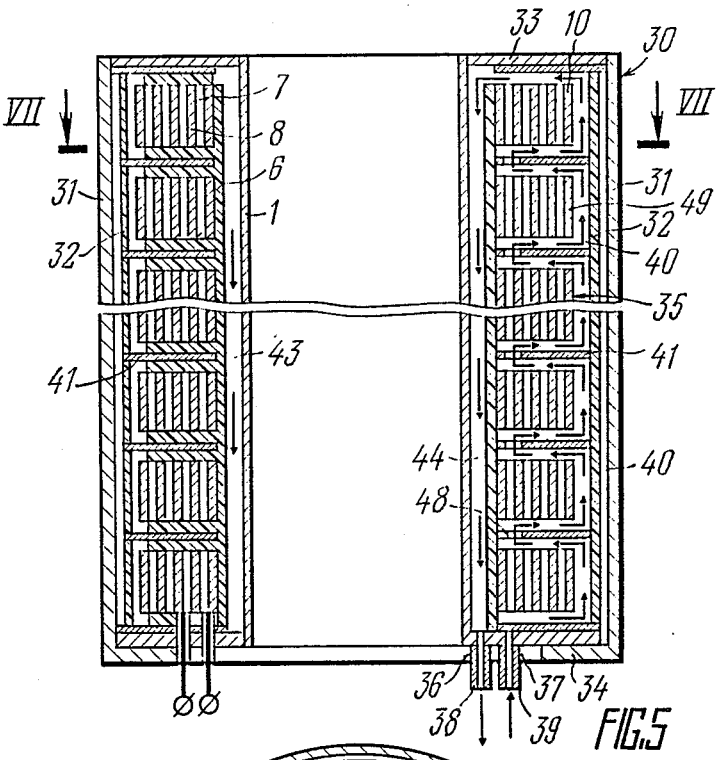
FIG. 5 is a third embodiment of the magnetic system (longitudinal section, side view) comprehended by this invention.

In a third embodiment the magnetic system comprises a casing 30 (FIG. 5) including an external enclosure 31 and an internal wall 32 with flanges 33, 34 secured on both ends of the external enclosure 31 and the internal wall 32 of the casing 30. The external enclosure 31, the internal wall 32 of the casing 30 and the flanges 33, 34 form in conjunction with the frame 1 a hermetically sealed cavity filled with coolant and accommodating coils 35 providing for the setting-up of a magnetic field. The flange 34 has holes 36, 37 to let in and out the coolant, pipes 38 and 39 being placed in said holes. A gap 40 is provided between the external enclosure 31 and the internal wall 32.

Each coil 35 comprises the former 6 with the conducting and insulating tapes 7 and 8 wound in layers thereon. Said tapes are cemented with compound and encompassed by the serving 10 on the outer surface.

Figure 6:
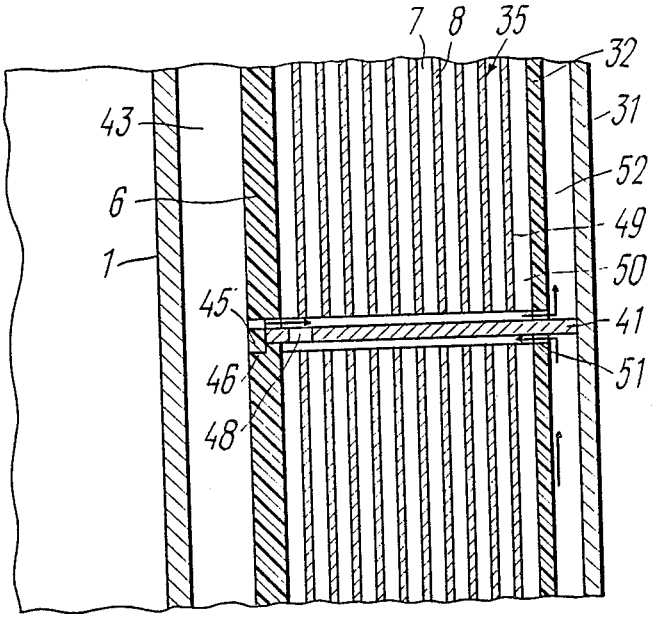
FIG. 6 shows the point of attachment of coil formers and disk partitions (longitudinal section) according to the invention.

The means for circulating coolant comprises disk partitions 41 made of a suitable insulating material. Secured between the frame 1 and an inner surface 42 of the formers 6 of the coils 35 are guide plates 43 (FIG. 7) used for providing a gap 44 to allow flow of said coolant. The ends of the formers 6 of the adjacent coils 35 (FIG. 6) are provided with projections 45 and slots 46, which are fitted in one another and used to interconnect the formers 6 of the coils 35. The disk partitions 41 are fixed round their inner periphery and pressed between the ends of the formers 6 of the coils 35 interconnected by the use of the projections 45 and the slots 46.

Figure 7:
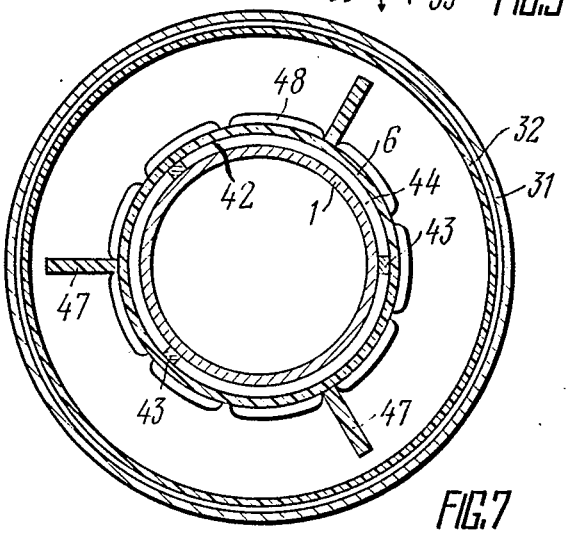
FIG. 7 is a cross-sectional view taken along line VII—VII of FIG. 5 (top view) in compliance with the invention.

The disk partitions 41 are attached to the internal wall 32 of the casing 30 round the outer periphery thereof. Three insulating spacers 47 are radially secured to upper and lower surfaces of each disk partition 41 (FIG. 7). The disk partitions 41 have holes 48 round the inner periphery. A gap 50 allowing flow of said coolant is provided between an outer lateral surface 49 (FIG. 5) of the coils 35 and the internal wall 32 of the casing 30.

Figure 8:
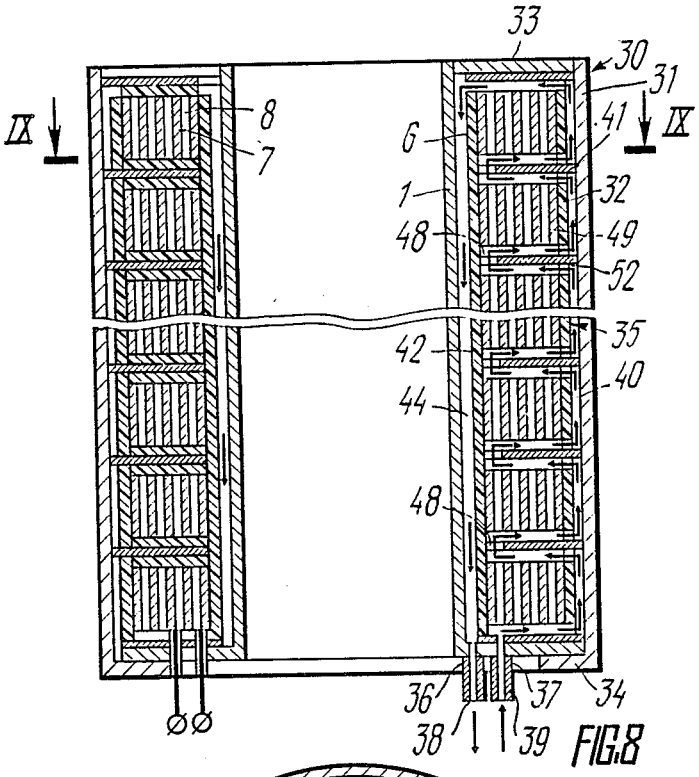
FIG. 8 is a fourth embodiment of the magnetic system (longitudinal section, side view) according to the invention.
Figure 9:
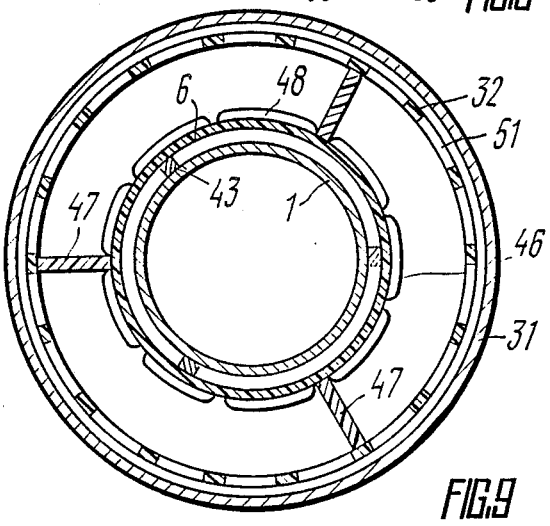
FIG. 9 is a cross-sectional view taken along line IX—IX of FIG. 8 (top view) according to the invention.

A fourth embodiment of the magnetic system is essentially similar to the third embodiment described above. In this case the disk partitions 41 (FIGS. 8 and 9) are fixed round the inner periphery thereof between the ends of the formers 6 of the coils 35 and attached to the internal wall 32 of the casing 30 round their outer periphery.

The disk partitions 41 have holes 48 round the inner periphery and hermetically abut on the external enclosure 31 of the casing 30 round the outer periphery. The internal wall 32 of the casing 30 is tightly fitted to an outer lateral surface 49 of the coils 35 and provided with holes 51 arranged in a symmetrical manner with respect to a point 52 of attachment of the disk partition 41 therein.

Figure 10:
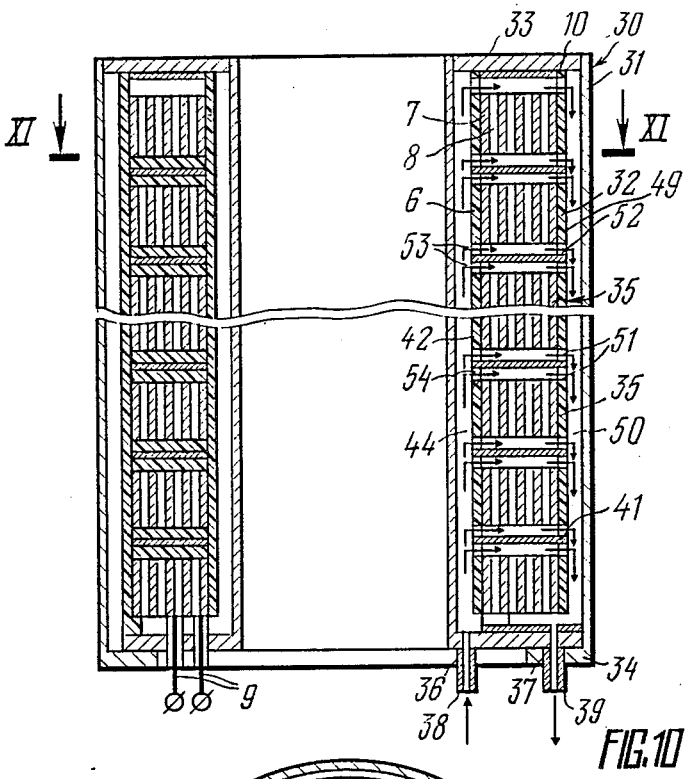
FIG. 10 is a fifth embodiment of the magnetic system (longitudinal section, side view) according to the invention.

In a fifth embodiment of the magnetic system, the disk partitions 41 (FIG. 10, 11) are continuous structures fixed round the inner periphery between the ends of the formers 6 of the coils 35 and attached to the internal wall 32 of the casing 30 round the outer periphery. The formers 6 of the coils 35 have holes 53 arranged symmetrically with respect to a point 54 attachment of the disk partition 41 therebetween. The internal wall 32 of the casing 30 is also provided with holes 51 arranged on both sides symmetrically with the point 52 of attachment of the disk partition 41 therein. The internal wall 32 of the casing 30 is tightly fitted to the outer lateral surface 49 of the coils 35.

Figure 12:
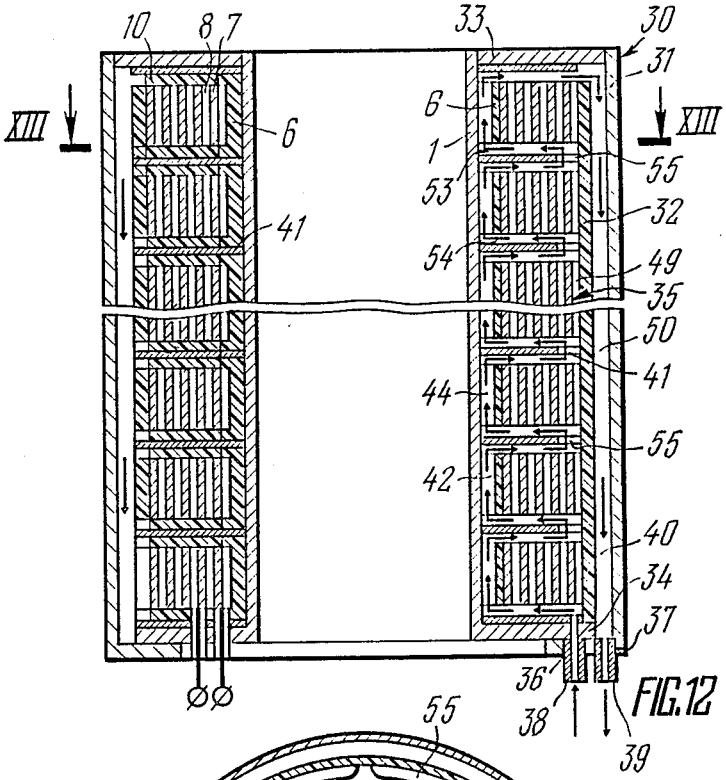
FIG. 12 is a sixth embodiment of the magnetic system (longitudinal section, side view) according to the invention.
Figure 13:
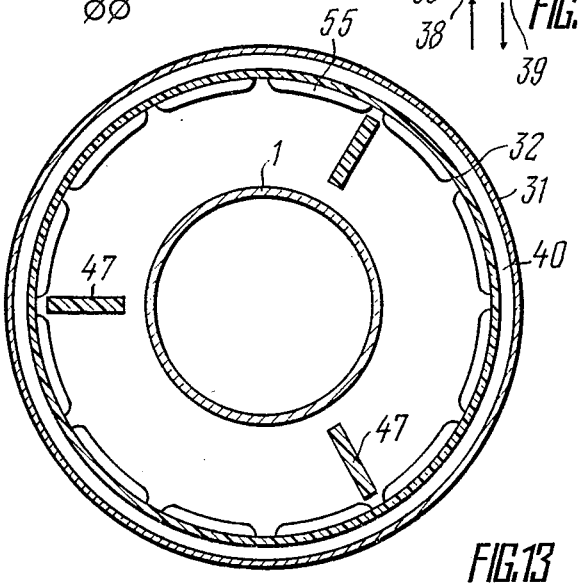
FIG. 13 is a cross-sectional view taken along line XIII—XIII of FIG. 11 (top view) according to the invention.

In a sixth preferred embodiment of the magnetic system, the disk partitions 41 (FIG. 12, 13) have holes 55 round the outer periphery and are fixed round the inner periphery between the ends of the formers 6 of the coils 35 and attached round the outer periphery to the internal wall 32 of the casing 30. The disk partitions 41 hermetically abut on the frame 1 round the outer periphery thereof. The formers 6 of the coils 35 have holes 53 arranged on both sides in a symmetrical manner with respect to the point 54 of attachment of the disk partition 41 therebetween. The internal wall 32 of the casing 30 is a continuous structure fitted tightly to the outer lateral surface 49 of the coils 35.

The magnetic system according to the invention is cooled in the following manner.

Connecting the current leads 9 (FIG. 1, 2) to a voltage source (not shown in the drawing) sets up a required magnetic field in the magnetic system. The coils 2, 3, 4 and 5 are noticeably heated in operation of the magnetic system. To cool the magnetic system, cooling fluid is supplied via the coolant inlet and outlet pipes 18 and 19, said fluid being pumped under pressure through the gap 15 between the end surfaces 11 of the coils 2, 3, 4, 5 and the cheeks 12.

Owing to end cooling, there is obtained a small temperature difference across the conducting tape 7 of the coils 2, 3, 4, 5 since heat conduction is good. For example, with a 100-mm wide copper strip 7 cooled on both ends of the coils 2, 3, 4, 5, a temperature difference across the conducting tape 7 amounts to 30% of the total temperature difference. A pressure loss in the gap 15 does not exceed 0.5 atm.

Due to this, the gap 15 may be fairly small (less than 1 cm) whereby a space factor in filling the coils 2, 3, 4, 5 with conducting material is increased to 0.85–0.9.

Figure 3:
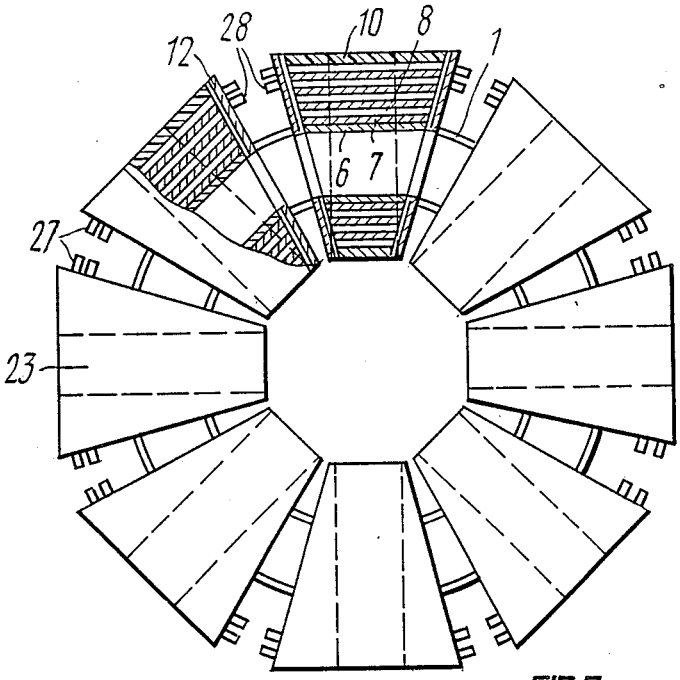
FIG. 3 is a second embodiment of the magnetic system (partial longitudinal section, side view) according to the invention.
Figure 4:
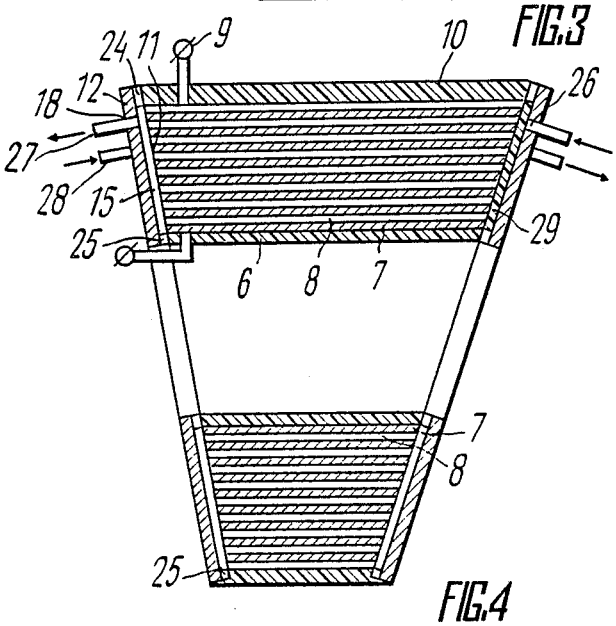
FIG. 4 shows a coil in the second embodiment of the magnetic system (longitudinal section) according to the invention.

In operation of the second embodiment of the magnetic system shown in FIG. 3 and 4, the cooling is effected in a manner similar to that described above.

In the third embodiment of the magnetic system, cooling fluid is supplied through the pipe 39 (FIG. 5, 7) to the end surface 11 of the first coil 35 and passes along the end surface 11 of the coil 35 and then via the gap 50 between the outer lateral surface 49 of the coils 35 and the internal wall 32 of the casing 30 to the other end surface 11 of said coil 35. Thereafter said cooling fluid is fed through the holes 48 round the inner periphery of the disk partition 41 to the end surface 11 of the next coil 35. Thus, the coils 35 are successively cooled by said fluid whereupon the latter is fed through the gap 44 between the frame 1 and the inner surface 42 of the formers 6 of the coils 35 to the coolant outlet pipe 38.

In the fourth embodiment of the invention, cooling fluid is supplied through the pipe 39 (FIGS. 8, 9) to the end surface 11 of the first coil 35 and then passes along the end surface 11 of said coil 35 through the gap 40 between the internal wall 32 of the casing 30 and the external enclosure 31 of the casing 30 by way of the holes 51 in the internal wall 32 of the casing 30 to the other end surface 11 of said coil 35. Heat is transferred to the external enclosure 31 of the casing 30, a feature making cooling of the magnetic system more effective. Thereafter said cooling fluid is fed through the holes 48 round the inner periphery of the disk partitions 41 to the end surface 11 of the next coil 35. After cooling all the coils 35, said fluid is supplied through the gap 44 between the frame 1 and the inner surface 42 of the formers 6 of the coils 35 to the coolant outlet pipe 39.

Figure 11:
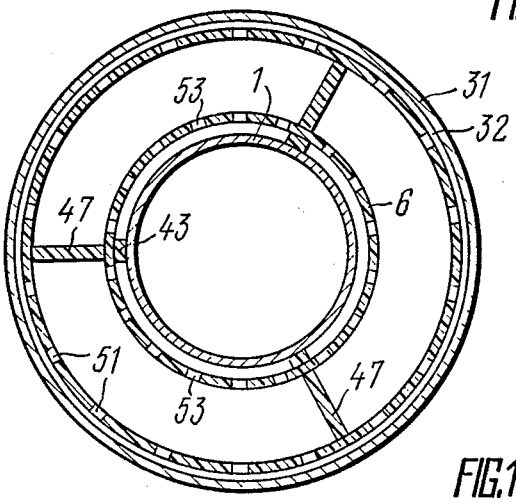
FIG. 11 is a cross-sectional view taken along line XI—XI of FIG. 10 (top view) according to the invention.

With the fifth preferred embodiment of the magnetic system, wherein the disk partitions 41 (FIGS. 10, 11) are continuous, the coils 35 are contained within a cavity formed by the former 6, the internal wall 32 of the casing 30, and the disk partitions 41. Cooling fluid is supplied through the gap 44 between the frame 1 and the inner surface 41 of the formers 6 of the coils 33, via the holes 53 in the formers 6 of the coils 35 and the holes 51 in the internal wall 32 of the casing 30. Thereafter said fluid is passed through the gap 40 between the inner wall 32 of the casing 30 and the external enclosure 31 of the casing 30.

Hence, there occurs parallel independent cooling of the coils 35 at which thermal conditions are essentially the same for all the coils 35 of the magnetic system.

In the sixth preferred embodiment of the invention, cooling fluid is supplied via the pipe 38 (FIG. 12) to the end surface 11 of the first coil 35 and then passes along the end surface 11 of said coil 35 through the holes 53 in the formers 6 of the coils 35 and through the gap 44 between the frame 1 and the inner surface 42 of the former 6 to the other end surface 11 of said coil 35. Thereafter said cooling fluid is fed through the holes in the disk partition 41 to the end surface 11 of the next coil 35. After cooling all the coils 35, said fluid flows through the gap 40 between the continuous internal wall 32 of the casing 30 and the external enclosure 31 of the casing 30 to the coolant outlet pipe 39.

The above cooling of the coils 35 fully prevents the appearance of stagnation zones, ensures a uniform process of cooling of the coils 35 and precludes electrochemical erosion of conducting surfaces of the magnetic system.

The present invention permits reducing ohmic losses in the magnetic system by 1.5 to 2 times and increasing induction of a magnetic fluid thereof by 15 to 20%.

What is claimed is:

1. A magnetic system comprising:

a frame;

at least one coil providing for setting-up of a magnetic field and having end surfaces, an inner lateral surface, and an outer lateral surface;

coil formers of each of said coils arranged coaxially on said frame;

conducting and insulating tapes wound in layers on said coil former;

a serving of each said coils encompassing an outer surface of each coil;

circulating means for circulating coolant, arranged in close proximity to end surfaces of said coils with a gap between said end surface of each coil and said circulating means;

said end surfaces of the coils being formed substantially by extremities of said conducting and insulating tapes; and a cooling system.

2. A magnetic system as claimed in claim 1, comprising:

said circulating means, which represent cheeks adapted to suit the shape of the end surface of said coils and secured on ends of said formers and servings;

holes provided in said cheeks;

coolant inlet and outlet pipes disposed in said holes;

a partition arranged radially between said coolant inlet and outlet pipes, the height of said partition being equal to the height of said gap between the end surface of each coil and the cheek.

3. A magnetic system as claimed in claim 2, further comprising projections arranged around the inner and outer periphery of said cheeks and secured, respectively, on ends of said formers and servings.

4. A magnetic system as claimed in claim 2, further comprising spacers disposed around the inner and outer periphery of the end surfaces of said coils and providing saig gap between the end surface of each coil and cheek.

5. A magnetic system as claimed in claim 1, additionally comprising:

a casing having first and second ends;

an external enclosure and an internal wall of said casing;

flanges secured on both ends of said casing so that said casing forms in conjunction with the frame a hermetically sealed cavity filled with coolant and accommodating said coils;

said frame and the inner surface of said coil formers with a gap provided therebetween to allow passage of coolant;

said circulating means being coolant, made as disk partitions of insulating material; said disk partitions having inner and outer peripheries and secured around the outer and inner periphery, respectively, on the former of said coils and on the internal wall of said casing.

6. A magnetic system as claimed in claim 5, wherein said coil formers are joined together; projections and slots provided on respective ends of the interconnected former of said coils and fitted in one another.

7. A magnetic system as claimed in claim 5, wherein:

said disk partitions have an inner and outer periphery; holes provided around the inner periphery of said disk partitions;

said outer lateral surface of the coils and the internal wall of the casing being provided with a gap therebetween to allow flow of coolant.

8. A magnetic system as claimed in claim 6, wherein:

said disk partitions have inner and outer peripheries; holes provided around the inner periphery of said disk partitions;

said outer lateral surface of the coils and the internal wall of the casing being provided with a gap provided therebetween to allow flow of coolant.

9. A magnetic system as claimed in claim 5, comprising:

said disk partitions having inner and outer peripheries and hermetically abuting on said external enclosure of the casing around the outer periphery thereof;

holes provided around the inner periphery of said disk partitions;

said internal wall of the casing being fitted tightly to said outer lateral surface of the coils;

holes provided in said internal wall of the casing and arranged on both sides in a symmetrical manner with respect to the point of attachment of said disk partition in the internal wall of the casing.

10. A magnetic system as claimed in claim 6, comprising:

said disk partitions having inner and outer peripheries and hermetically abutting on said external enclosure of the casing around the outer periphery thereof;

holes provided around the inner periphery of said disk partitions;

said internal wall of the casing being fitted tightly to said outer lateral surface of the coils; holes provided in said internal wall of the casing and arranged on both sides in a symmetrical manner with respect to the point of attachment of said disk partition in the internal wall of the casing.

11. A magnetic system as claimed in claim 5, comprising:

said disk partitions made as continuous structures;

holes provided in the coil formers and arranged on both sides in a symmetrical manner relative to the point of attachment of said disk partition in said coil formers;

said internal wall of the casing fitted tightly to said outer lateral surface of the coils;

holes provided in said internal wall of the casing and arranged in a symmetrical manner relative to the point of attachment of said disk partition in said internal wall of the casing.

12. A magnetic system as claimed in claim 6, comprising:

said disk partitions made as continuous structures;

holes provided in the coil formers and arranged on both sides in a symmetrical manner relative to the point of attachment of said disk partition in said formers;

said internal wall of the casing fitted tightly to said outer lateral surface of the coils; holes provided in said internal wall of the casing and arranged on both sides in a symmetrical manner relative to the point of attachment of said disk partition in said internal wall of the casing.

13. A magnetic system as claimed in claim 5, comprising:

said disk partitions having inner and outer peripheries and abutting on said frame around the inner periphery thereof;

holes provided in said disk partitions around outer periphery thereof;

said internal wall of the casing fitted tightly to said outer lateral surface of the coils;

holes provided in said coil formers and arranged on both sides in a symmetrical manner relative to the point of attachment of said disk partitions in said coil formers.

14. A magnetic system as claimed in claim 6, comprising:

said disk partitions having inner and outer peripheries and abutting on said frame around the inner periphery thereof;

holes provided in said disk partitions around the outer periphery thereof;

said internal wall of the casing fitted tightly to said outer lateral surface of the coils;

holes provided in said coil formers and arranged on both sides in a symmetrical manner relative to the point of attachment of said disk partitions in said coil formers.

15. A magnetic system as claimed in claim 2, comprising:

a partition arranged radially between said coolant inlet and outlet pipes, the height of said partition being equal to the height of said gap between the end surface of each coil and the cheek;

at least two additional insulating spacers secured radially on the surface of each means for circulating coolant, the height of said spacers being equal to the height of said gap between the end surface of each coil and said means.

16. A magnetic system as claimed in claim 5, comprising additionally:

at least two insulating spacers secured radially on the surface of each means for circulating coolant, the height of said spacers being equal to the height of said gap between the end surface of each coil and said means.

17. A magnetic system as claimed in claim 7, comprising additionally:

at least two insulating spacers secured radially on the surface of each means for circulating coolant, the height of said spacers being equal to the height of said gap between the end surface of each coil and said means.

18. A magnetic system as claimed in claim 9, comprising additionally:

at least two insulating spacers secured radially on the surface of each circulating means, the height of said spacers being equal to the height of said gap between the end surface of each coil and said means.

19. A magnetic system as claimed in claim 11, comprising additionally:

at least two insulating spacers secured radially on the surface of each means for circulating coolant, the height of said spacers being equal to the height of said gap between the end surface of each coil and said means.

20. A magnetic system as claimed in claim 13, comprising additionally:

at least two insulating spacers secured radially on the surface of each circulating means, the height of said spacers being equal to the height of said gap between the end surface of each coil and said means.

21. A magnetic system as claimed in claim 15, further comprising:

transverse channels provided in said insulating spacers.

22. A magnetic system as claimed in claim 16, further comprising:

transverse channels provided in said insulating spacers.

* * * * *